US008081918B2

(12) United States Patent
Suzuki

(10) Patent No.: US 8,081,918 B2
(45) Date of Patent: Dec. 20, 2011

(54) DEVELOPER TRANSPORTATION DEVICE AND IMAGE FORMING APPARATUS

(75) Inventor: Masayuki Suzuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 390 days.

(21) Appl. No.: 12/232,133

(22) Filed: Sep. 11, 2008

(65) Prior Publication Data

US 2009/0087228 A1 Apr. 2, 2009

(30) Foreign Application Priority Data

Sep. 27, 2007 (JP) ..... 2007-251804

(51) Int. Cl.
*G03G 21/00* (2006.01)

(52) U.S. Cl. ..... 399/358; 399/256

(58) Field of Classification Search ..... 399/254, 399/256, 258, 263, 358
See application file for complete search history.

(56) References Cited

U.S. PATENT DOCUMENTS 5,307,129 A * 4/1994 Miura et al. ..... 399/263
5,848,342 A * 12/1998 Tanda ..... 399/358
6,014,541 A * 1/2000 Kato et al. ..... 399/358
6,456,809 B1 * 9/2002 Sekiguchi ..... 399/254
7,315,723 B2 * 1/2008 Suda et al. ..... 399/358
2006/0222414 A1 * 10/2006 Yamamura ..... 399/263

FOREIGN PATENT DOCUMENTS

| | | |
|---|---|---|
| JP | 06-067539 | 3/1994 |
| JP | 07-334051 | 12/1995 |
| JP | 2005-128444 | 5/2005 |
| JP | 2006-058729 | 3/2006 |
| JP | 2007-034157 | 2/2007 |

* cited by examiner

*Primary Examiner* — David Gray
*Assistant Examiner* — Barnabas Fekete
(74) *Attorney, Agent, or Firm* — Kubotera & Associates, LLC

(57) ABSTRACT

A developer transportation device includes a storage portion for storing developer; a transportation member formed of an elastic material and disposed in the storage portion to be freely rotatable for transporting the developer upon rotating; and a rotation transmission member for transmitting a rotation to the transportation member. The transportation member may be provided with an abutting portion abutting against a wall portion of the storage portion when the transportation member rotates.

24 Claims, 10 Drawing Sheets

DEVELOPER TRANSPORTATION DEVICE AND IMAGE FORMING APPARATUS

BACKGROUND OF THE INVENTION AND RELATED ART STATEMENT

The present invention relates to a developer transportation device for supplying a sheet and an image forming apparatus having the developer transportation device.

In a conventional image forming apparatus such as a printer, a copier, a facsimile, and the likes, a charge roller charges a surface of a photosensitive drum, and an LED (Light Emitting Diode) head exposes the surface of the photosensitive drum to form a static latent image thereon. Then, a developing roller attaches a thin layer of toner to the static latent image through static electricity, thereby forming a toner image. A transfer roller transfers the toner image to a sheet, and a fixing device fixes the toner image to the sheet, thereby forming an image on the sheet. After the transfer roller transfers the toner image to the sheet, a cleaning blade scrapes off toner remaining on the photosensitive drum, so that toner is collected as waste toner.

When the cleaning blade collects waste toner, a toner transportation device as a developer transportation device transports waste toner to a waste toner box, so that waste toner can be discarded externally. The toner transportation device includes a transportation spiral as a transportation member having a coil shape. When the transportation spiral rotates, the transportation spiral transports waste toner (refer to Patent Reference).

Patent Reference: Japan Patent Publication No. 2006-58729

SUMMARY OF THE INVENTION

According to the present invention, a developer transportation device includes a storage portion for storing developer; a transportation member formed of an elastic material and disposed in the storage portion to be freely rotatable for transporting the developer upon rotating; and a rotation transmission member for transmitting a rotation to the transportation member.

According to the present invention, the transportation member may be provided with an abutting portion abutting against a wall portion of the storage portion when the transportation member rotates.

In the present invention, the developer transportation device includes the storage portion for storing the developer; the transportation member formed of the elastic material and disposed in the storage portion to be freely rotatable for transporting the developer upon rotating; and the rotation transmission member for transmitting the rotation to the transportation member. The transportation member may be provided with the abutting portion abutting against the wall portion of the storage portion when the transportation member rotates.

In the present invention, when the transportation member rotates, the abutting portion abuts against the wall portion of the storage portion, thereby generating a vibration. Accordingly, when the developer becomes an agglomerate on the wall portion of the storage portion, it is possible to brake up and scrape off the agglomerate. As a result, it is possible to prevent the transportation member from being damaged due to the agglomerate, thereby extending lifetime of the developer transportation device.

DETAILED DESCRIPTION OF THE PREFERRED EMBODIMENTS

Hereunder, embodiments of the present invention will be described in detail with reference to the accompanying drawings. In the following description, a printer will be explained as an image forming apparatus.

First Embodiment

Figure 2:
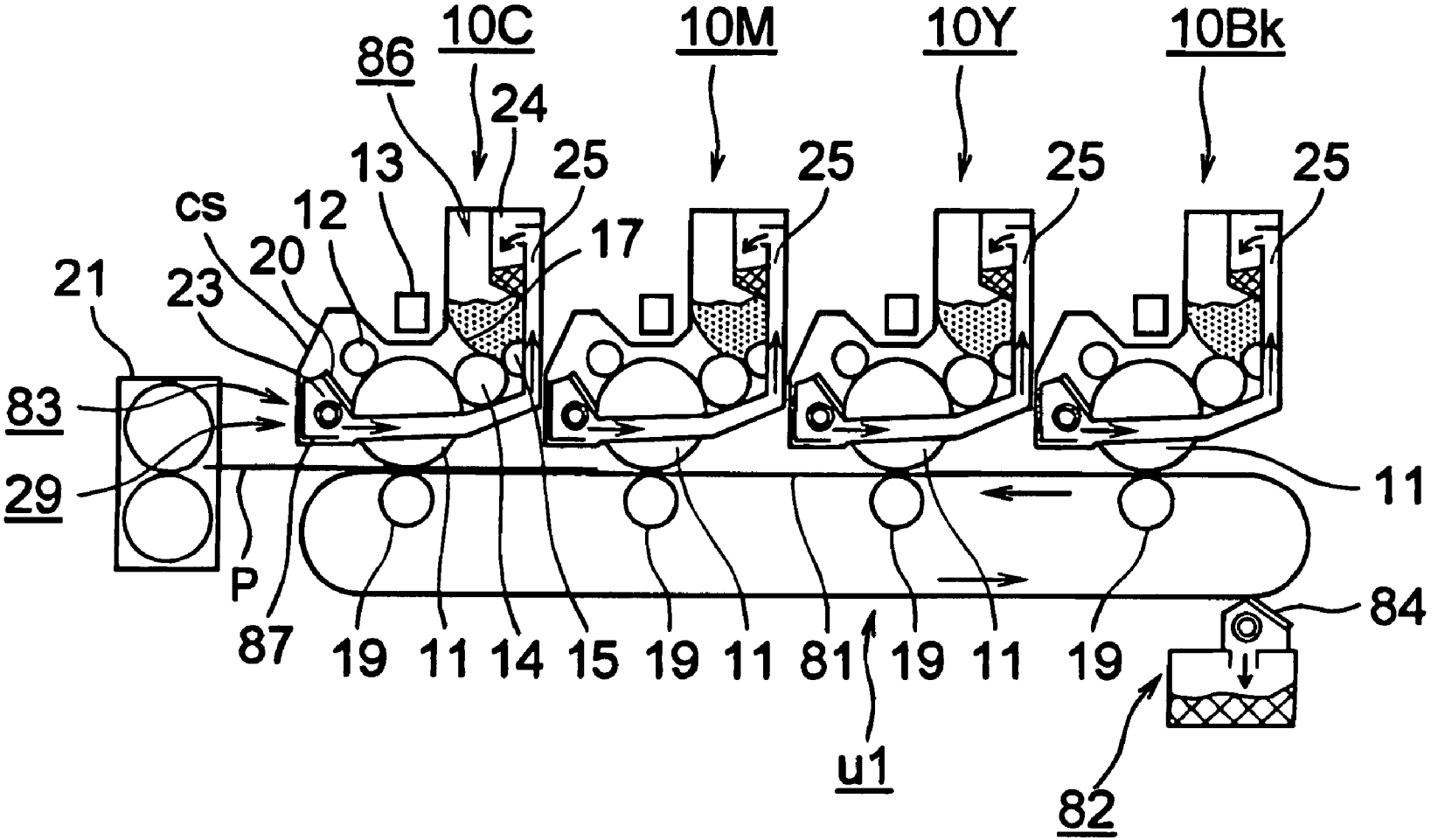
FIG. 2 is a schematic side view showing a printer according to the first embodiment of the present invention.

A first embodiment of the present invention will be explained. FIG. 2 is a schematic side view showing a printer according to the first embodiment of the present invention.

As shown in FIG. 2, the printer includes image forming units (ID units) 10Bk, 10Y, 10M, and 10C for forming toner images as developer images in black, yellow, magenta, and cyan, respectively, according to image data. The printer also includes a transfer unit u1 of a belt type disposed to face the image forming units 10Bk, 10Y, 10M, and 10C, so that transfer areas in each color are formed between the transfer unit u1 and the image forming units 10Bk, 10Y, 10M, and 10C for transferring the toner images in each color to a sheet P as a medium.

In the embodiment, the printer further includes a sheet supply cassette (not shown) as a medium storage portion for supplying the sheet P to each of the transfer areas and a fixing unit 21 as a fixing device for fixing the color toner images to the sheet P after the toner images are transferred to the sheet P in the transfer areas.

In the embodiment, the transfer unit u1 includes a drive roller (not shown) as a first roller connected to a motor (not shown) as a transfer drive portion for rotating upon receiving a rotation of the motor; an idle roller (not shown) as a second roller for rotating while following the rotation of the drive roller; an endless belt 81 as a transfer belt or a belt placed between the drive roller and the idle roller; transfer rollers 19 disposed inside the endless belt 81 to face photosensitive drums 11 as static latent image supporting members of the image forming units 10Bk, 10Y, 10M, and 10C, and to be freely movable; and a first cleaning device 82 disposed near the idle roller for abutting against an outer circumferential surface of the endless belt 81. The idle roller is arranged to apply tension to the endless belt 81, and alternatively a tension roller may be disposed.

In the embodiment, the image forming units 10Bk, 10Y, 10M, and 10C have an identical configuration. Each of the image forming units 10Bk, 10Y, 10M, and 10C includes the photosensitive drum 11 arranged to be freely rotatable. Further, each of the image forming units 10Bk, 10Y, 10M, and 10C includes a charge roller 12 as a charging device, a developing roller 14 as a first developer image supporting member, and a second cleaning device 83 arranged in this order along a rotational direction of the photosensitive drum 11. An LED (Light Emitting Diode) head 13 as an exposure device is disposed between the charge roller 12 and the developing roller 14 to face the photosensitive drum 11 for exposing a surface of the photosensitive drum 11, thereby forming a static latent image as a latent image thereon.

In the embodiment, the charge roller 12 is formed of a conductive shaft made of stainless steel and the likes, and the conductive shaft is covered with a conductive elastic member made of an epichlorohydrin rubber and the likes. The charge roller 12 is arranged to contact with the photosensitive drum 11. The LED head 13 is formed of an LED element and a lens array. When the LED element emits light, the lens array collects light and forms an image on the surface of the photosensitive drum 11.

In the embodiment, the developing roller 14 is formed of a conductive shaft made of stainless steel and the likes, and the conductive shaft is covered with a conductive elastic member made of a urethane rubber and the likes. A surface of the developing roller 14 is polished to have an appropriate roughness, and may be coated if necessary. The developing roller 14 is arranged to contact with the photosensitive drum 11.

In the embodiment, a toner supply roller 15 as a developer supply member and a developing blade 17 as a developer regulating member are disposed around the developing roller 14. The toner supply roller 15 is formed of a conductive shaft made of stainless steel and the likes, and the conductive shaft is covered with a foam elastic member made of a silicone rubber and the likes.

In the embodiment, the developing blade 17 is formed of a metal plate made of stainless steel. A distal end portion of the metal plate is bent at a specific curvature to form a curved portion. The curved portion is polished and pressed against the developing roller 14 for regulating a layer thickness of toner as developer supplied from the toner supply roller 15 to the developing roller 14.

In the embodiment, the transfer roller 19 is formed of a conductive shaft made of stainless steel and the likes, and the conductive shaft is covered with a foam elastic member made of a silicone rubber and the likes. The transfer rollers 19 are arranged to press against the photosensitive drums 11 with the endless belt 81 in between.

In the embodiment, the first cleaning device 82 includes a cleaning blade 84 as a first cleaning member, so that the cleaning blade 84 scrapes off toner attached to the endless belt 81. In this case, the endless belt 81 constitutes a second developer supporting member.

In the embodiment, the first cleaning device 82 is attached to each of the image forming units 10Bk, 10Y, 10M, and 10C. The second cleaning device 83 includes a waste toner storage portion 29 as a first storage portion or a first developer waste transportation path extending in an axial direction along the photosensitive drum 11; a cleaning blade 20 as a second cleaning member attached to a wall portion 87 of the waste toner storage portion 29 at a specific position thereof; and a transportation spiral 23 as a first transportation member disposed in the waste toner storage portion 29 below the cleaning blade 20 to be freely rotatable. The cleaning blade 20 is provided for scraping off toner remaining on the photosensitive drum 11. Note that the photosensitive drum 11 constitutes a third developer supporting member.

In the embodiment, the cleaning blade 20 is formed of a metal plate having a curved shape, and a urethane rubber with a rectangular shape is attached to the metal plate. Further, the cleaning blade 20 is arranged such that a distal end portion of the urethane rubber is pressed against the photosensitive drum 11 with a specific linear pressure.

In the embodiment, the waste toner storage portion 29 is integrally formed with a housing body cs, and may be formed separately from the housing body cs. The transportation spiral 23 is formed of a wire made of an elastic material such as stainless steel, and the wire is formed in a specific shape.

In the embodiment, a toner cartridge 86 as a developer cartridge is disposed above the developing roller 14 for storing toner. The toner cartridge 86 is detachably attached to a main body of each of the image forming units 10Bk, 10Y, 10M, and 10C or an image forming unit main body. A waste toner tank 24 as a developer waste storage container is disposed inside a main body of the toner cartridge 86 or a container main body for storing waste toner or developer waste scraped off with the cleaning blade 20.

In the embodiment, a waste toner collection route 25 as a second storage portion or a second developer waste transportation path connects the second cleaning device 83 and the waste toner tank 24. Note that the second cleaning device 83 and the waste toner collection route 25 constitute a waste toner transportation unit as a developer waste transportation unit.

An operation of the printer will be explained next. First, in each of the image forming units 10Bk, 10Y, 10M, and 10C, a charge voltage is applied to the charge roller 12, so that the charge roller 12 uniformly charges the surface of the photosensitive drum 11. Then, image data are sent to the LED head 13, so that the LED head 13 exposes the surface of the photosensitive drum 11, thereby forming the static latent image thereon.

When toner is supplied from the toner cartridge 86 to the image forming unit main body, the toner supply roller 15 supplies toner to the developing roller 14. Then, the developing blade 17 forms a thin layer of toner on the developing roller 14, so that toner is attached to the photosensitive drum 11, thereby developing the static latent image to form the toner image in each color.

In the next step, a transfer voltage is applied to the transfer roller 19, so that the toner image on the photosensitive drum 11 is sequentially overlapped and transferred to the sheet P, thereby forming a color toner image. The, the sheet P is transported to the fixing unit 21, so that the color toner image is fixed to the sheet P in the fixing unit 21, thereby forming a color image. Through the operation described above, a printing operation is performed.

After the toner image in each color is transferred to the sheet P, the cleaning blade 20 scrapes off toner remaining on the photosensitive drum 11. After the cleaning blade 20 scrapes off toner, toner is collected in the waste toner storage portion 29 as waste toner. Then, the transportation spiral 23 disposed in the waste toner storage portion 29 transports waste toner to the waste toner collection route 25, so that waste toner is stored therein. After waste toner is stored in the waste toner collection route 25, waste toner is transported from the waste toner collection route 25 to the waste toner tank 24.

When the printing operation is repeated, and waste toner is gradually agglomerated and forms an agglomerate in the waste toner storage portion 29, the agglomerate may stick to an inner wall portion of the wall portion 87. Accordingly, it is difficult to collect waste toner scraped off with the cleaning blade 20 any more, thereby causing cleaning malfunction.

Further, waste toner tends to agglomerate on a downstream side of the waste toner storage portion 29, i.e., a portion near the waste toner collection route 25. When waste toner is accumulated on the agglomerate, a large load is applied to the transportation spiral 23. In an extreme case, the transportation spiral 23 may be damaged.

To this end, in the embodiment, it is configured such that it is possible to prevent waste toner from agglomerating in the waste toner collection route 25.

Figure 1:
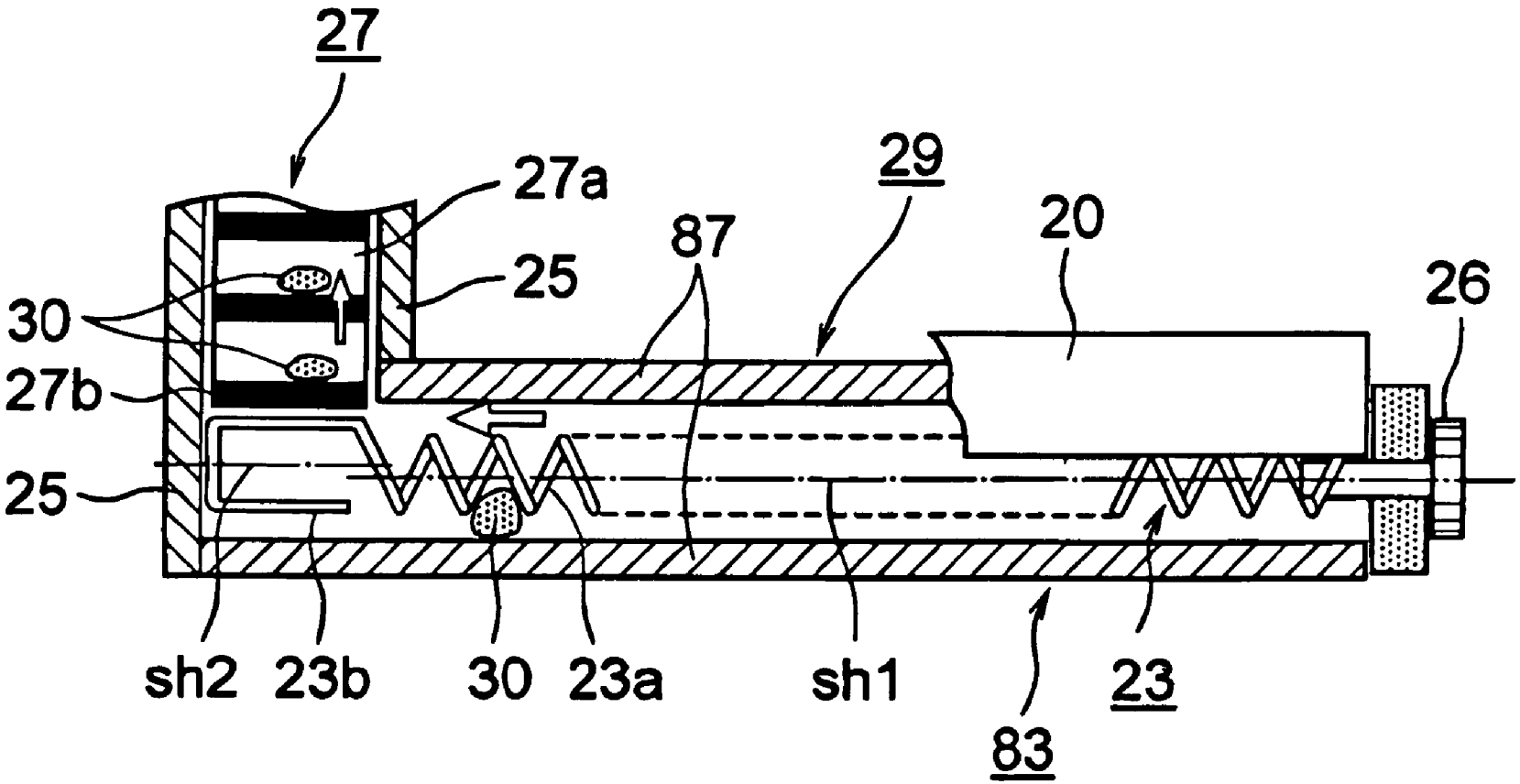
FIG. 1 is a schematic view showing a waste toner transportation unit according to a first embodiment of the present invention.
Figure 3:
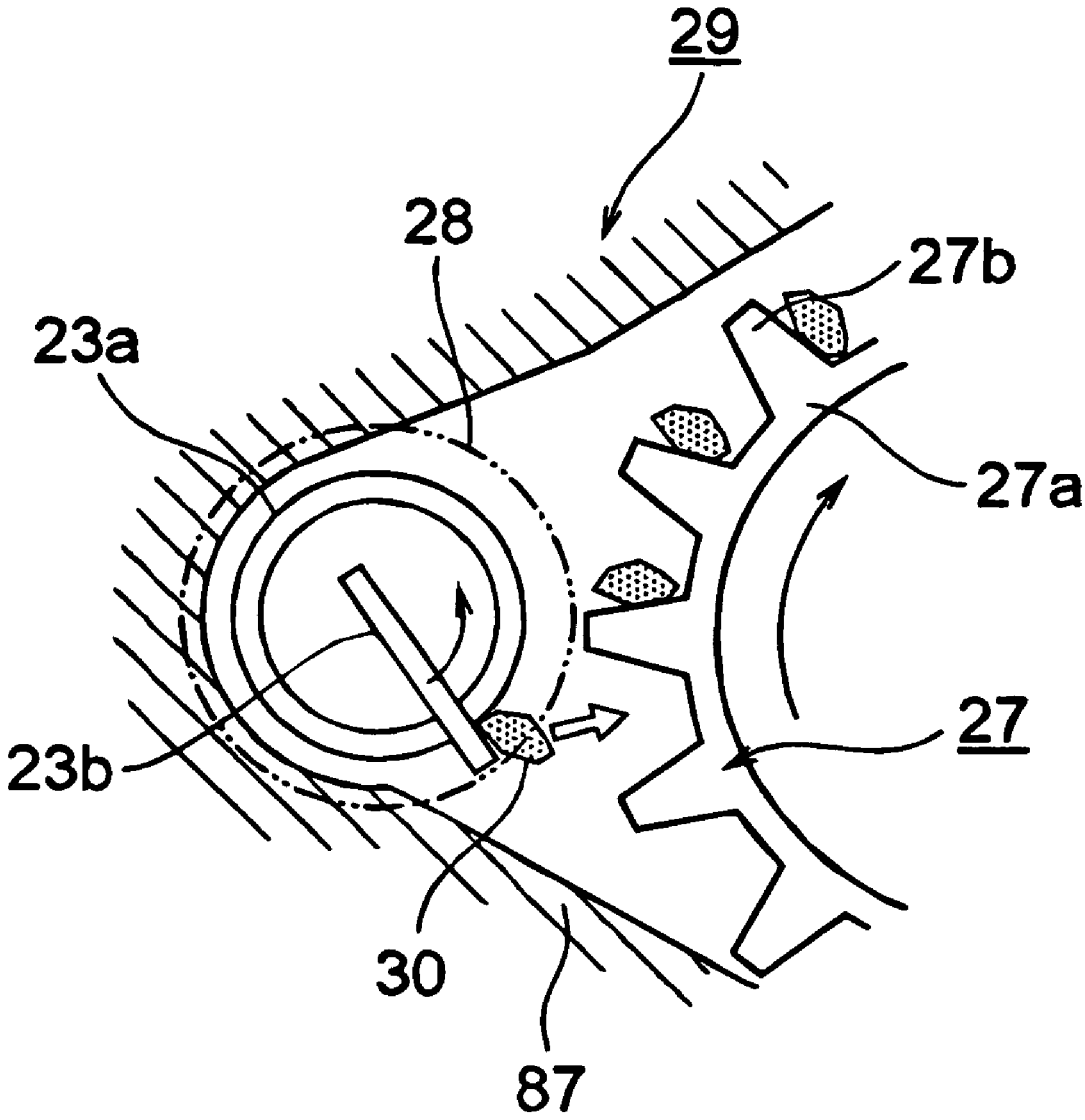
FIG. 3 is a schematic view showing a waste toner receiving portion according to the first embodiment of the present invention.

The waste toner transportation unit will be explained in more detail next. FIG. 1 is a schematic view showing the waste toner transportation unit according to the first embodiment of the present invention. FIG. 3 is a schematic view showing a waste toner receiving portion according to the first embodiment of the present invention.

As shown in FIG. 1, the waste toner transportation unit includes the second cleaning device 83, the cleaning blade 20, and the transportation spiral 23. The transportation spiral 23 includes a main body portion 23*a* and a discharge portion 23*b*. The main body portion 23*a* is formed of a stainless steel wire with a circular cross section formed in a coil shape. The discharge portion 23*b* is formed at a specific position, i.e., one end portion, of the main body portion 23*a* as a free end portion, and is formed of a wire having a U character shape.

In the embodiment, a drive gear 26 as a rotation transmission member is attached to the other end portion of the main body portion 23*a* for transmitting a rotation to the transportation spiral 23. The drive gear 26 is connected to a discharge motor (not shown) as a discharge drive unit for discharging waste toner 30 to the waste toner collection route 25. Note that the waste toner collection route 25, the transportation spiral 23, and the cleaning blade 20 constitute a developer transportation device.

In the embodiment, the main body portion 23*a* has a rotational shaft sh1, and the discharge portion 23*b* has a rotational shaft sh2. As shown in FIG. 3, the rotational shaft sh2 is shifted relative to the rotational shaft sh1, so that a rotational path 28 of the discharge portion 23*b* partially interferes with the wall portion 87. In this case, the discharge portion 23*b* constitutes an abutting portion, and the wall portion 87 constitutes an abutted portion.

In the embodiment, a transportation belt 27 as a second transportation member is disposed in the waste toner collection route 25. A transportation motor (not shown) as a transportation drive unit drives the transportation belt 27 to move.

In the embodiment, the waste toner receiving portion is formed at a connecting portion between the waste toner collection route 25 and one end portion of the waste toner storage portion 29. The discharge portion 23*b* is situated adjacent to the transportation belt 27 at the waste toner receiving portion. The transportation belt 27 is formed of a flexible plastic, and includes a belt main body 27*a* formed in a band shape and a plurality of teeth portion 27*b* as a transportation section protruding outwardly from the belt main body 27*a* with an equal interval in between. Note that the discharge portion 23*b* is arranged to face the waste toner collection route 25 and the transportation belt 27.

Figure 4:
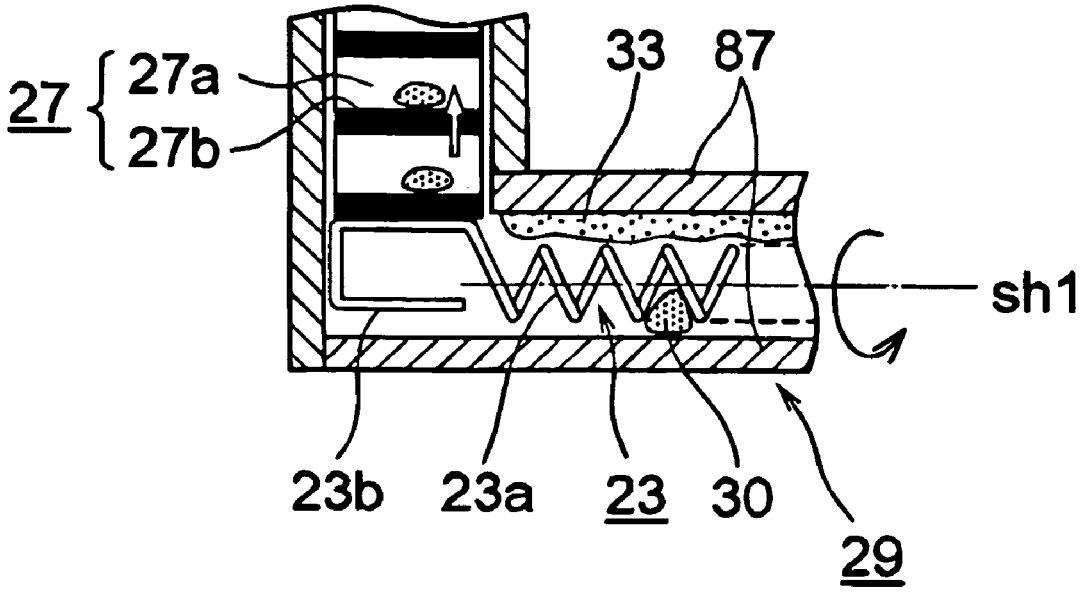
FIG. 4 is a schematic view No. 1 showing an operation of the waste toner transportation unit according to the first embodiment of the present invention.
Figure 5:
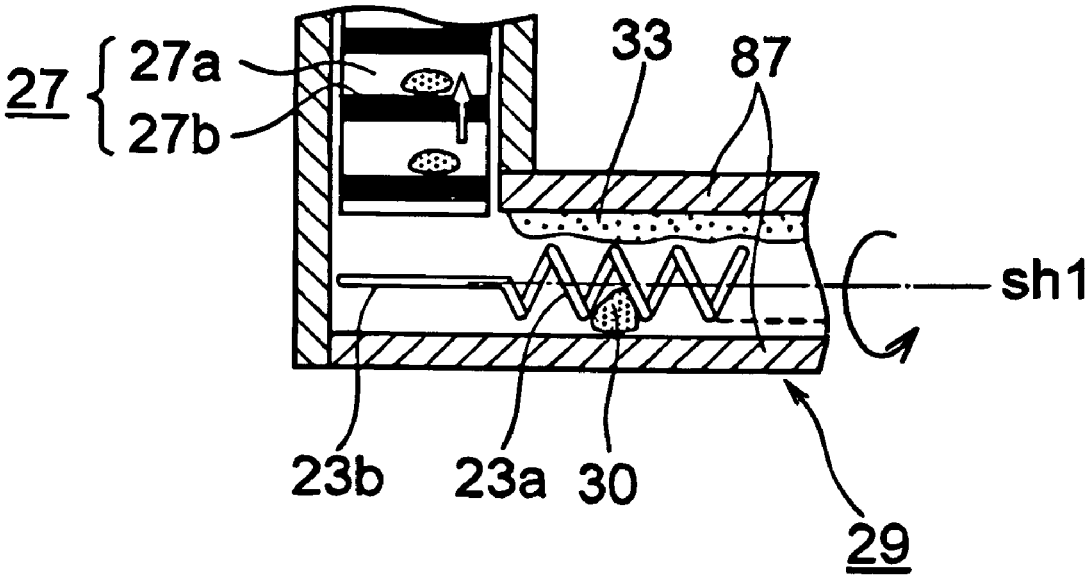
FIG. 5 is a schematic view No. 2 showing the operation of the waste toner transportation unit according to the first embodiment of the present invention.

An operation of the waste toner transportation unit will be explained. FIG. 4 is a schematic view No. 1 showing the operation of the waste toner transportation unit according to the first embodiment of the present invention. FIG. 5 is a schematic view No. 2 showing the operation of the waste toner transportation unit according to the first embodiment of the present invention.

Figure 6:
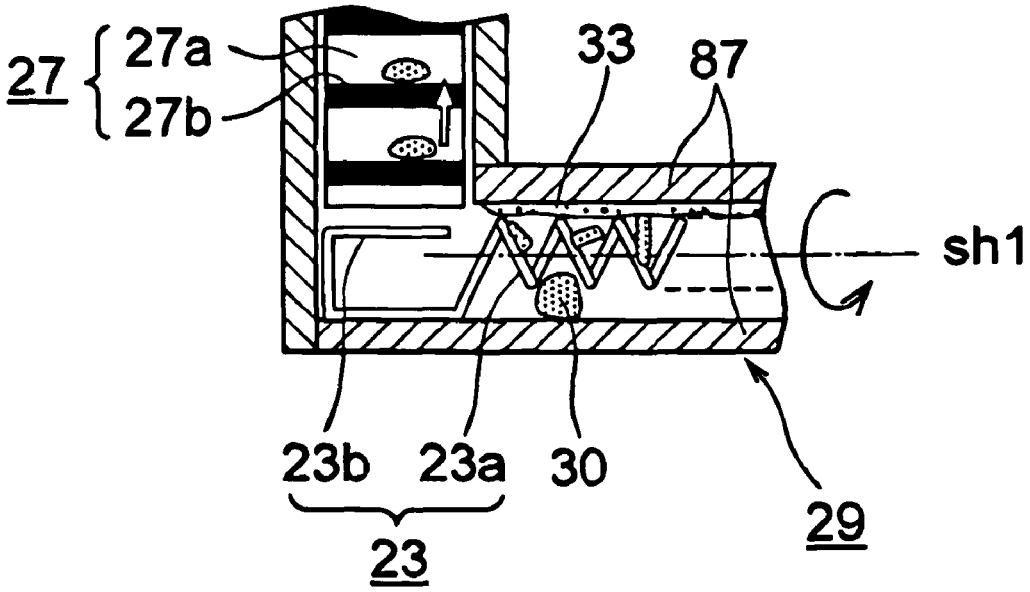
FIG. 6 is a schematic view No. 3 showing the operation of the waste toner transportation unit according to the first embodiment of the present invention.
Figure 7:
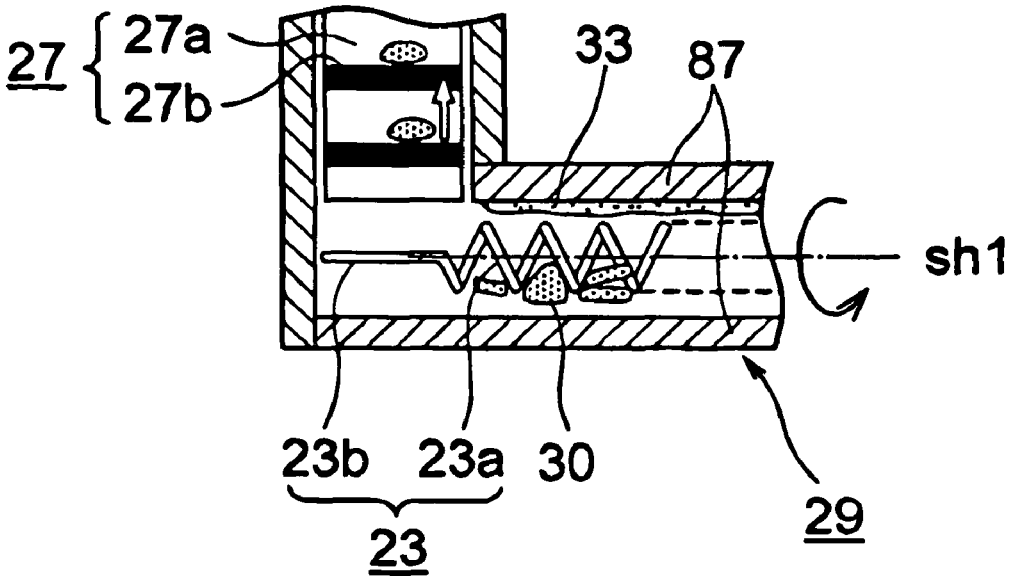
FIG. 7 is a schematic view No. 4 showing the operation of the waste toner transportation unit according to the first embodiment of the present invention.

FIG. 6 is a schematic view No. 3 showing the operation of the waste toner transportation unit according to the first embodiment of the present invention. FIG. 7 is a schematic view No. 4 showing the operation of the waste toner transportation unit according to the first embodiment of the present invention. When the transportation spiral 23 rotates, the operation shown in FIGS. 4 to 7 is repeated in this order.

When the transportation motor drives, a rotation of the transportation motor is transmitted to the drive gear 26, so that the transportation spiral 23 rotates around the rotation shaft sh1 in the waste toner storage portion 29. As described above, the cleaning blade 20 scrapes off the waste toner 30 from the photosensitive drum 11, and the waste toner 30 is collected in the cleaning blade 20. Accordingly, the coil portion of the main body portion 23*a* pushes the waste toner 30 toward the waste toner collection route 25 to the connecting portion, so that the discharge portion 23*b* transports the waste toner 30 from the transportation spiral 23 to the transportation belt 27 at the connecting portion. Then, the transportation belt 27 moves to transport the waste toner 30 further to the waste toner tank 24.

In the embodiment, as described above, the discharge portion 23*b* is shifted relative to the main body portion 23*a*. When the transportation spiral 23 rotates, the rotational path 28 of the discharge portion 23*b* partially interferes with the wall portion 87, so that the discharge portion 23*b* repeatedly abuts against the wall portion 87.

As a result, as shown in FIG. 6, the main body portion 23*a* is deformed periodically, and the rotational shaft sh1 is deformed locally. When the discharge portion 23*b* does not abut against the wall portion 87, the main body portion 23*a* returns to an original shape thereof. Accordingly, as shown in FIG. 7, the rotational shaft sh1 returns to an original shape thereof.

As described above, the transportation spiral 23 is formed of the wire formed in the coil shape, and has elasticity. Accordingly, when the main body portion 23*a* is deformed periodically, the transportation spiral 23 vibrates as a whole. With the vibration, it is possible to crash and scrape off the agglomerate 33 of the waste toner 30 formed on the inner wall portion of the wall portion 87.

As described above, in the embodiment, every time the transportation spiral 23 rotates, the vibration is generated. Accordingly, it is possible to prevent the waste toner 30 from agglomerating and the agglomerate 33 from being formed. The main body portion 23*a* is formed in the coil shape. Accordingly, the transportation spiral 23 vibrates along an irregular path, so that is it possible to crash the agglomerate 33 of the waste toner 30 over a large area. It is possible to prevent the waste toner 30 from accumulating in the waste toner storage portion 29, thereby preventing the transportation spiral 23 from being damaged, and increasing a lifetime of the toner transportation device as the developer transportation device.

In the embodiment, the discharge portion 23*b* is formed at the one end portion of the transportation spiral 23, and the discharge portion 23*b* constitutes the abutting portion. Alternatively, other portion of the transportation spiral 23 may constitute the abutting portion.

Second Embodiment

A second embodiment of the present invention will be explained next. Components in the second embodiment similar to those in the first embodiment are designated with the same reference numerals, and explanations thereof are omitted. The components in the second embodiment similar to those in the first embodiment provide similar effects.

Figure 8:
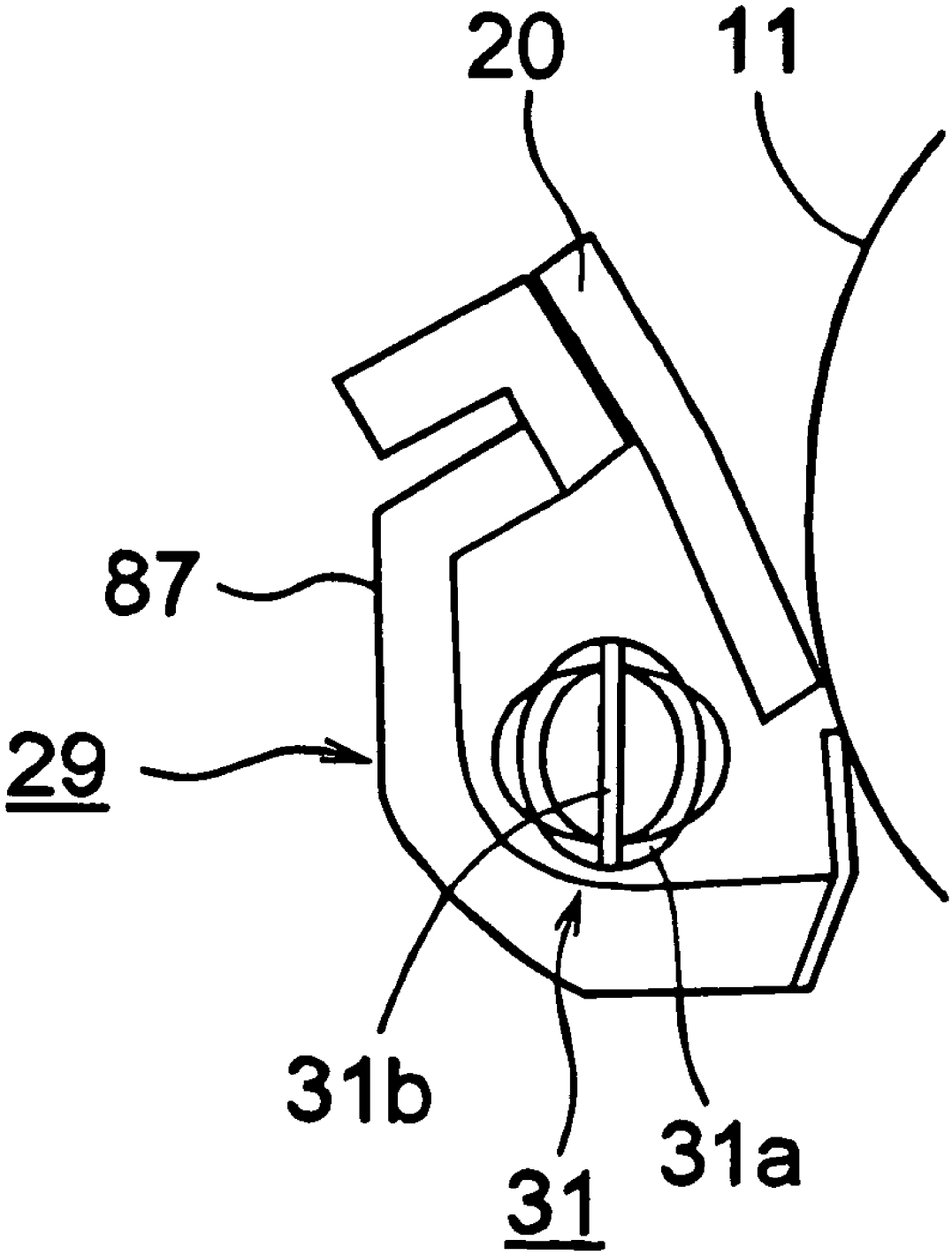
FIG. 8 is a schematic sectional view showing a cleaning device according to a second embodiment of the present invention.

FIG. 8 is a schematic sectional view showing a cleaning device according to the second embodiment of the present invention.

In the embodiment, a transportation spiral 31 includes a main body portion 31*a* and a discharge portion 31*b* having a U character shape. The main body portion 31*a* is formed in a coil shape having an oval cross section. A wire made of stainless steel is wound around a metal shaft having an oval cross section to form the main body portion 31*a*.

An operation of the transportation spiral 31 will be explained next. As described above, the main body portion 31*a* has the coil shape having the oval cross section. Accordingly, when the transportation spiral 31 rotates, the transportation spiral 31 itself moves and vibrates in a vertical direction and a lateral direction. As a result, it is possible to prevent the waste toner 30 from agglomerating and the agglomerate 33 from being formed. Even when the agglomerate 33 of the waste toner 30 is formed on the inner wall portion of the wall portion 87, the transportation spiral 31 vibrates to crash and scrape off the agglomerate 33.

As described above, the main body portion 31*a* has the coil shape having the oval cross section. Accordingly, a portion of the transportation spiral 31 having a larger diameter contacts with the wall portion 87. That is, the transportation spiral 31 contacts with the wall portion 87 all the time. Accordingly, it is possible to increase an amount of toner to be transported and prevent noise due to an impact.

Third Embodiment

A third embodiment of the present invention will be explained next. Components in the third embodiment similar to those in the first and second embodiments are designated with the same reference numerals, and explanations thereof are omitted. The components in the third embodiment similar to those in the first and second embodiments provide similar effects.

In the first embodiment, the transportation spiral 23 is formed of the wire having the circular cross section. Accordingly, when the waste toner 30 agglomerates, the agglomerate 33 tends to be formed through a mechanism described below.

Figure 9:
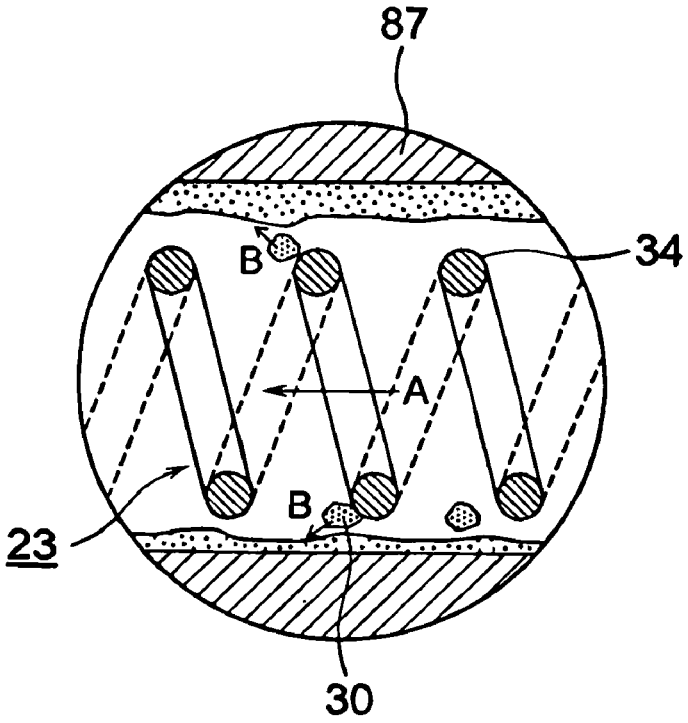
FIG. 9 is an enlarged schematic sectional view No 1 showing a mechanism of forming an agglomerate.
Figure 10:
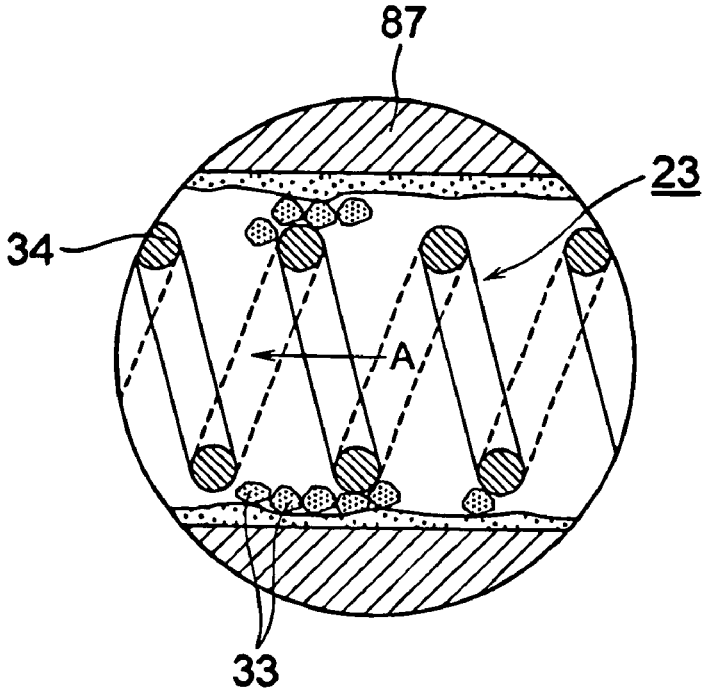
FIG. 10 is an enlarged schematic sectional view No 2 showing the mechanism of forming the agglomerate.

FIG. 9 is an enlarged schematic sectional view No 1 showing a mechanism of forming the agglomerate 33. FIG. 10 is an enlarged schematic sectional view No 2 showing the mechanism of forming the agglomerate 33.

As shown in FIGS. 9 and 10, the transportation spiral 23 is formed of a wire 34. When the transportation spiral 23 rotates, the waste toner 30 is transported in an arrow direction A. As the wire 34 has a circular cross section, the waste toner 30 situated near the transportation spiral 23 receives a force in an arrow direction B and is pushed outwardly in a radial direction. Accordingly, the waste toner 30 tends to agglomerate on the inner wall portion of the wall portion 87, thereby forming the agglomerate 33. When the transportation spiral 23 rotates at a higher rotational speed, the transportation spiral 23 pushes the waste toner 30 outwardly in the radial direction with a larger force, thereby further forming the agglomerate 33.

Figure 11:
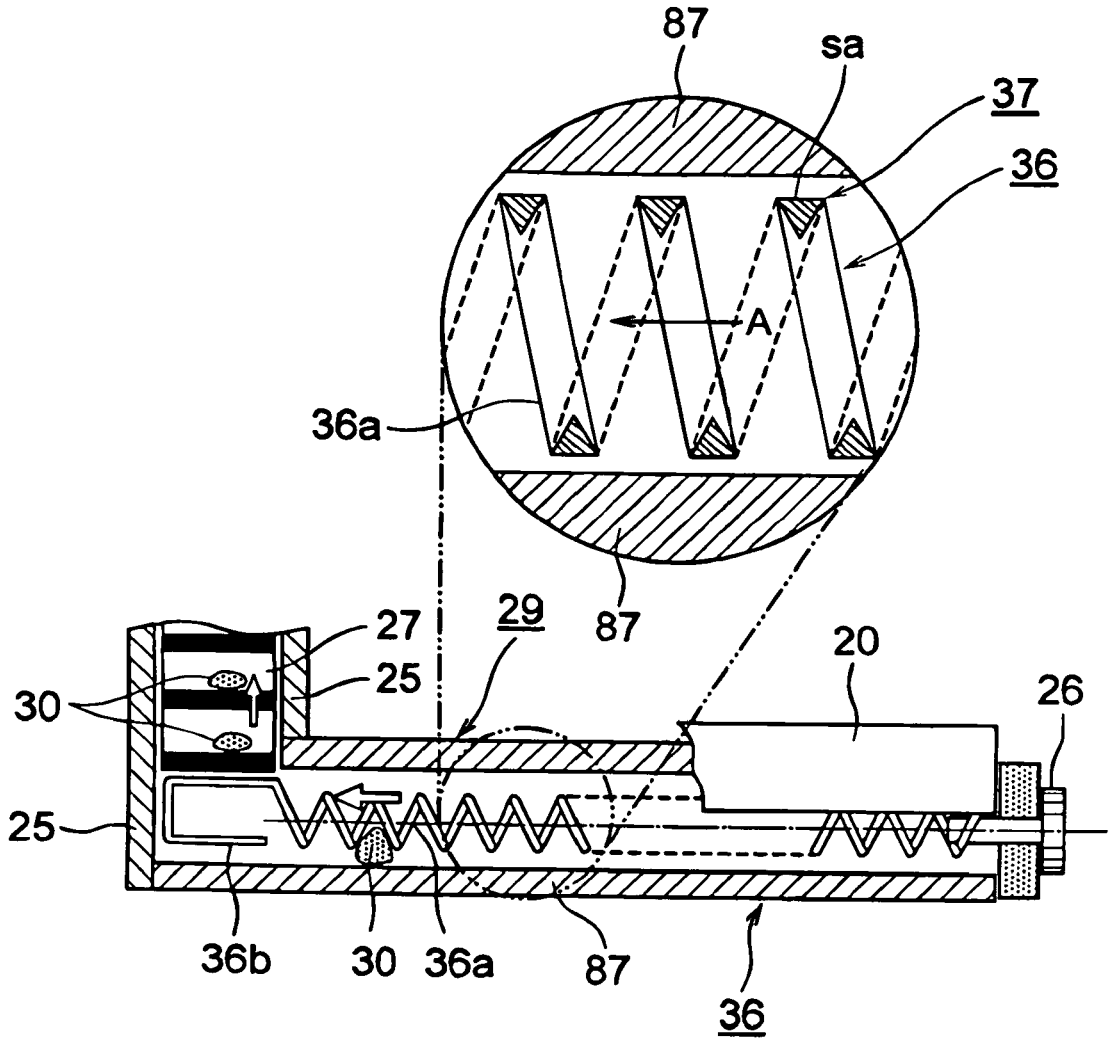
FIG. 11 is a schematic view showing a waste toner transportation unit according to a third embodiment of the present invention.
Figure 12:
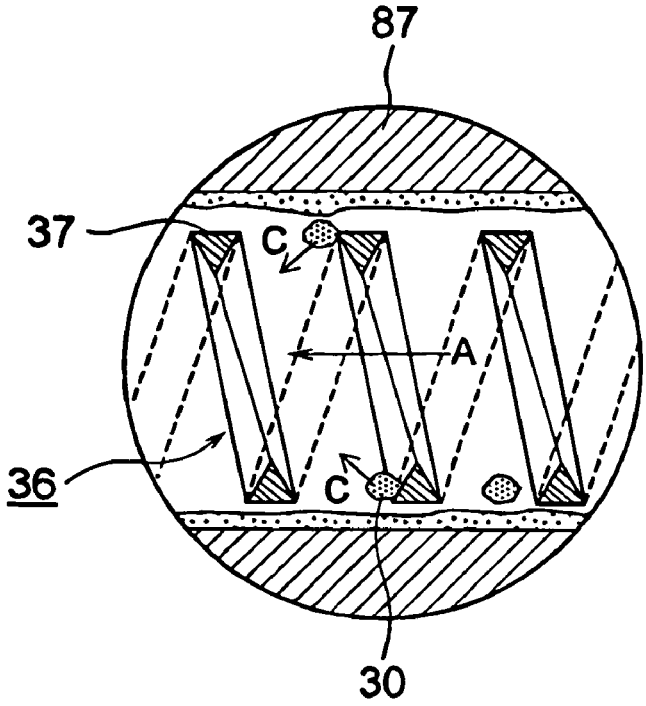
FIG. 12 is a schematic view No. 1 showing an operation of a transportation spiral according to the third embodiment of the present invention.
Figure 13:
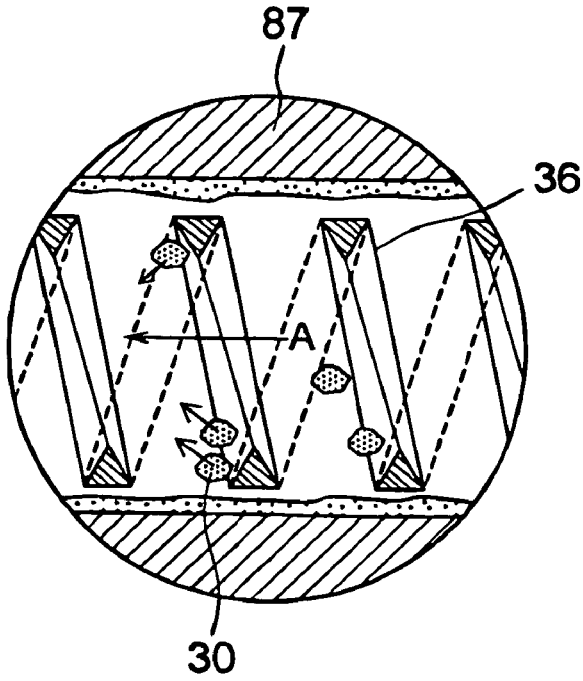
FIG. 13 is a schematic view No. 2 showing the operation of the transportation spiral according to the third embodiment of the present invention.

In the third embodiment, it is possible to prevent the agglomerate 33 from being formed more efficiently. FIG. 11 is a schematic view showing a waste toner transportation unit according to a third embodiment of the present invention. FIG. 12 is a schematic view No. 1 showing an operation of a transportation spiral 36 according to the third embodiment of the present invention. FIG. 13 is a schematic view No. 2 showing the operation of the transportation spiral 36 according to the third embodiment of the present invention.

In the embodiment, the transportation spiral 36 is formed of a wire 37, and the wire 37 has a triangular shape section having three top portions, that is, the wire 37 is formed of an irregular section wire. The transportation spiral 36 includes a main body portion 36*a* and a discharge portion 36*b*. The wire 37 has one surface sa situated at an outer circumferential edge of the main body portion 36*a*.

When the transportation spiral 36 rotates, the waste toner 30 is transported in an arrow direction A. Since the wire 37 has the triangular shape section, the waste toner 30 situated near the transportation spiral 36 receives a force in an arrow direction C, so that the waste toner 30 is pushed inwardly in a radial direction of the transportation spiral 36. Accordingly, it is possible to prevent the waste toner 30 from agglomerating, and the agglomerate 33 from being formed on the inner wall portion of the wall portion 87.

In the embodiment, even when the agglomerate 33 is formed, the agglomerate 33 is not pushed outwardly in the radial direction of the transportation spiral 36. Accordingly, when the transportation spiral 36 rotates, it is possible to easily crash and scrape off the agglomerate 33 of the waste toner 30 formed on the inner wall portion of the wall portion 87.

In the embodiment, the discharge portion 36*b* interferes with the wall portion 87, so that the transportation spiral 36 vibrates. Accordingly, it is possible to easily scrape off the agglomerate 33 of the waste toner 30 formed on the inner wall portion of the wall portion 87 with a corner of the wire 37. Note that the features in the third embodiment may be applied to the features in the second embodiment.

Fourth Embodiment

A fourth embodiment of the present invention will be explained next. Components in the fourth embodiment similar to those in the first to third embodiments are designated with the same reference numerals, and explanations thereof are omitted. The components in the fourth embodiment similar to those in the first to third embodiments provide similar effects.

Figure 14:
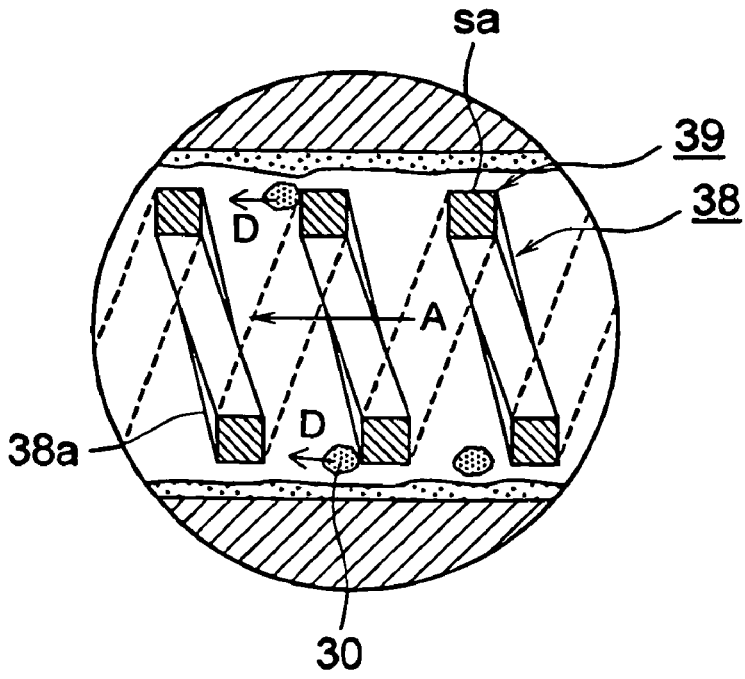
FIG. 14 is a schematic view No. 1 showing an operation of a transportation spiral according to a fourth embodiment of the present invention.
Figure 15:
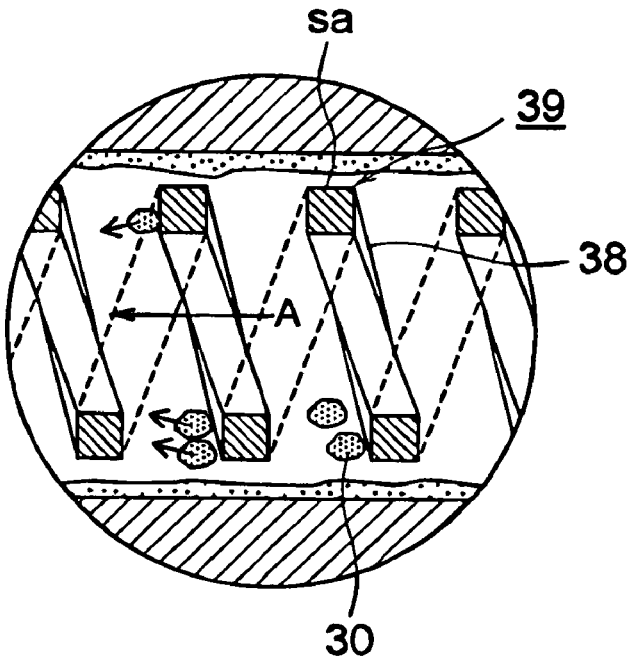
FIG. 15 is a schematic view No. 2 showing the operation of the transportation spiral according to the fourth embodiment of the present invention.

FIG. 14 is a schematic view No. 1 showing an operation of a transportation spiral 38 according to the fourth embodiment of the present invention. FIG. 15 is a schematic view No. 2 showing the operation of the transportation spiral 38 according to the fourth embodiment of the present invention.

In the embodiment, the transportation spiral 38 is formed of a wire 39, and the wire 39 has a rectangular shape section having four corner portions, that is, the wire 39 is formed of an irregular section wire. The transportation spiral 38 includes a main body portion 38*a* and a discharge portion (not shown). The wire 39 has one surface sa situated at an outer circumferential edge of the main body portion 38*a*.

When the transportation spiral 38 rotates, the waste toner 30 is transported in an arrow direction A. Since the wire 39 has the rectangular shape section, the waste toner 30 situated near the transportation spiral 38 receives a force in an arrow direction D, so that the waste toner 30 is pushed in an axial direction of the transportation spiral 36. Accordingly, it is possible to prevent the waste toner 30 from agglomerating, and the agglomerate 33 from being formed on the inner wall portion of the wall portion 87.

In the embodiment, it is possible to transport a large amount of the waste toner 30 with a large transportation force with the transportation spiral 38. Accordingly, even when the agglomerate 33 is formed, only a small amount of the waste toner 30 reaches an inner circumferential surface of the wall portion 87, thereby making it easy to crash the agglomerate 33. Further, since the wire 39 has the rectangular shape section with the corners, when the transportation spiral 38 rotates, it is possible to easily crash and scrape off the agglomerate 33 of the waste toner 30 formed on the inner wall portion of the wall portion 87.

In the embodiment, the discharge portion interferes with the wall portion 87, so that the transportation spiral 38 vibrates. Accordingly, it is possible to easily scrape off the agglomerate 33 of the waste toner 30 formed on the inner wall portion of the wall portion 87 with a corner of the wire 39. Note that the features in the fourth embodiment may be applied to the features in the second embodiment.

In the embodiments described above, the present invention is applied to the printer as the image forming apparatus, and may be applicable to other device, for example, a copier, a facsimile, and a multifunction product.

In the embodiments described above, the present invention is applied to the second cleaning device 83, and may be applicable to the first cleaning device 82. Further, the present invention may be applicable to a portion through which toner is transported from one container to another container. Further, the features in the first embodiment may be combined with those in the third embodiment.

The disclosure of Japanese Patent Application No. 2007-251804, filed on Sep. 27, 2007, is incorporated in the application by reference.

While the invention has been explained with reference to the specific embodiments of the invention, the explanation is illustrative and the invention is limited only by the appended claims.

What is claimed is:

1. A developer transportation device comprising:

a storage portion for storing developer, said storage portion including a wall portion having an arc shape section with a first diameter;

a transportation member formed of an elastic material and disposed in the storage portion to be freely rotatable for transporting the developer upon rotating, said transportation member including an abutting portion moving along a circular path with a second diameter greater than the first diameter so that the abutting portion reciprocally abuts against the wall portion of the storage portion when the transportation member rotates; and a rotation transmission member for transmitting a rotation to the transportation member, wherein said transportation member further includes a main body portion formed of a wire member and having a coil shape.

2. The developer transportation device according to claim 1, wherein said abutting portion is bent in a specific shape.

3. The developer transportation device according to claim 1, wherein said main body portion has the coil shape having an oval cross section, said abutting portion being situated at a long diameter of the oval cross section.

4. The developer transportation device according to claim 1, wherein said wire member has a corner portion.

5. The developer transportation device according to claim 1, wherein said wire member has a section having one of a triangular shape and a rectangular shape.

6. The developer transportation device according to claim 1, wherein said abutting portion is situated at least one of both end portions of the transportation member.

7. The developer transportation device according to claim 1, wherein said storage portion is adopted to store the developer removed from a developer supporting member with a cleaning member.

8. The developer transportation device according to claim 7, wherein said storage portion is adopted to store the developer removed from a static latent image supporting member as the developer supporting member.

9. The developer transportation device according to claim 7, wherein said storage portion is adopted to store the developer removed from a transfer belt as the developer supporting member.

10. The developer transportation device according to claim 1, wherein said transportation member further includes a rotation transmission member disposed at one end portion thereof, said abutting portion being disposed at the other, end portion of the transportation member.

11. The developer transportation device according to claim 1, further comprising a collection portion for collecting the developer, said abutting portion being disposed at a position facing the collection portion.

12. An image forming apparatus comprising the developer transportation device according to claim 1.

13. A developer transportation device comprising:

a storage portion for storing developer;

a transportation member formed of an elastic material and disposed in the storage portion to be rotatable around a rotational axis for transporting the developer upon rotating, said transportation member having an oval shape; and a rotation transmission member for transmitting a rotation to the transportation member, wherein said transportation member includes an abutting portion abutting against a wall portion of the storage portion when the transportation member rotates, and a main body portion formed of a wire member and having a coil shape.

14. The developer transportation device according to claim 13, wherein said abutting portion is bent in a specific shape.

15. The developer, transportation device according to claim 13, wherein said main body portion has the coil shape having an oval cross section, said abutting portion being situated at a long diameter of the oval cross section.

16. The developer transportation device according to claim 13, wherein said wire member has a corner portion.

17. The developer transportation device according to claim 13, wherein said wire member has a section having one of a triangular shape and a rectangular shape.

18. The developer transportation device according to claim 13, wherein said abutting portion is situated at least one of both end portions of the transportation member.

19. The developer transportation device according to claim 13, wherein said storage portion is adopted to store the developer removed from a developer supporting member with a cleaning member.

20. The developer transportation device according to claim 19, wherein said storage portion is adopted to store the developer removed from a static latent image supporting member as the developer supporting member.

21. The developer transportation device according to claim 19, wherein said storage portion is adopted to store the developer removed from a transfer belt as the developer supporting member.

22. The developer transportation device according to claim 13, wherein said transportation member further includes a rotation transmission member disposed at one end portion thereof, said abutting portion being disposed at the other end portion of the transportation member.

23. The developer transportation device according to claim 13, further comprising a collection portion for collecting the developer, said abutting portion being disposed at a position facing the collection portion.

24. An image forming apparatus comprising the developer transportation device according to claim 13.

* * * * *